350-168 AU 257 Ex
7/22/80 XR 4,214,297

United States Patent [19]
Kühn et al.

[11] 4,214,297
[45] Jul. 22, 1980

[54] ARRANGEMENT FOR SPECTRAL DISPERSION OF A BUNDLE OF LIGHT

[75] Inventors: Gebhard Kühn; Ludwig Meier, both of Jena, German Democratic Rep.

[73] Assignee: Jenoptik Jena G.m.b.H., Jena, German Democratic Rep.

[21] Appl. No.: 878,609

[22] Filed: Feb. 7, 1978

[30] Foreign Application Priority Data

Mar. 29, 1977 [DD] German Democratic Rep. ... 198110

[51] Int. Cl.[2] ..... F21V 5/00
[52] U.S. Cl. ..... 362/327; 350/168; 362/339
[58] Field of Search ..... 362/252, 35, 1, 2, 327, 362/328, 339, 340; 350/168

[56] References Cited

U.S. PATENT DOCUMENTS 1,043,009 10/1912 Hoffman ..... 350/168
2,443,258 6/1948 Lindenblad ..... 350/168

FOREIGN PATENT DOCUMENTS 558536 1/1975 Switzerland ..... 350/168

*Primary Examiner*—Harold J. Tudor

[57] ABSTRACT

The invention is in concern of an arrangement for producing artificial rainbows, particularly for use in planetaria, in which a bundle of light emitted from a light source and directed through an aperture upon a prism is dispersed by the latter and reflected at a cylindrical reflector. Due to the reflection at the cylindrical reflector the projected light bundle is of a rainbow shape, the radius thereof depends on the position of the cylindrical reflector relative to the prism.

1 Claim, 1 Drawing Figure

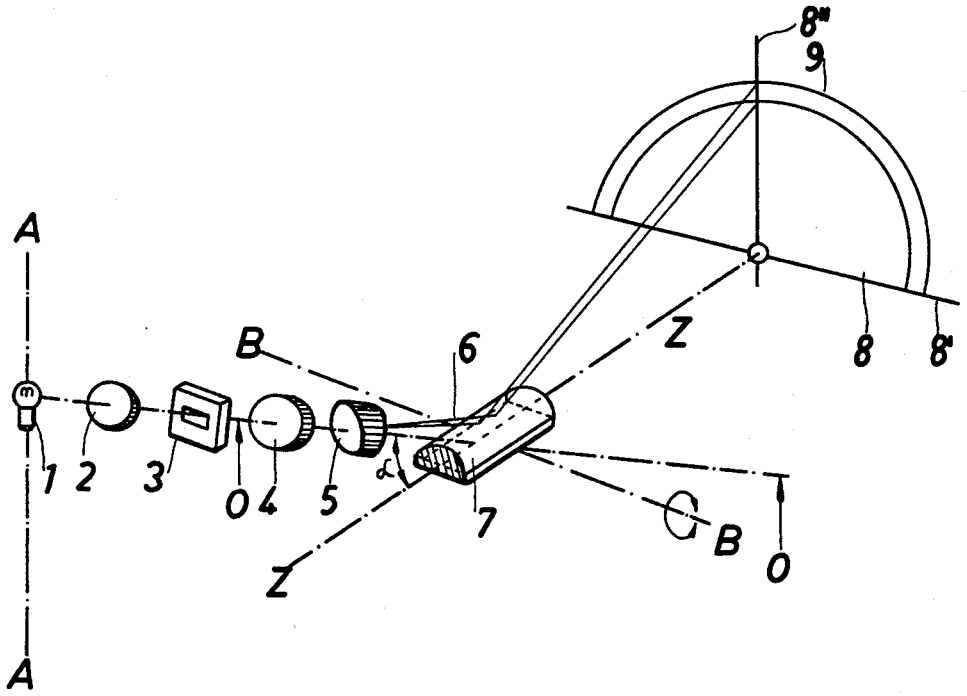
8'''
9
A
B
6
Z
8
8'
1
2
3
0
4
5
α
7
B
0
Z
A

ARRANGEMENT FOR SPECTRAL DISPERSION OF A BUNDLE OF LIGHT

The invention is concerned with an arrangement for spectral dispersion of a bundle of light, particularly for producing an artificial rainbow in a planetarium, comprising a light source for emitting a bundle of light in which, considered in the direction of light propagation, a condensor lens, a slit aperture, an optical imaging system and a prism for dispersing the bundle of light into the colours of the spectrum are arranged.

Previous devices for producing artificial rainbows (DT-OS 2 243 335) employ a curved prism rod for splitting a light beam into the colours of the spectrum, where the prism rod is either of triangular or trapezoidal cross-section. Depending on the radius of the desired rainbow, the prism rod has to be of a corresponding length and/or radius. However, with an increasing radius and length of arc of the rainbow, the required glass bulk for producing the respective prism, also increases, which involves the danger of mechanical instability, apart from the considerable production costs, since only single pieces are produced.

Due to the curved geometry of the prism rod, the impinging light is refracted in several directions and reflected in such a manner that the emitted spectrum forms a parabola. When, in the known device, the shape and radius of the artificial rainbow has to be varied, different prism rods have to be employed which limits the variability.

Concerning the optical qualities of the prism rod material, there are no high demands, which is easily to be understood when one considers the kind of production, which is very simple, and the use of the prism rods in practice, namely, in advertising, exhibitions, and window display. The prism rods are scarcely used for scientific purposes. It is an object of the present invention to obviate the above disadvantages.

It is a further object of the present invention to provide a means for simulating a rainbow which is substantially identical to one occuring under natural conditions. These objects are realised by a projection arrangement and a prism for splitting a bundle of light to yield a rainbow, in that the light bundle after passage through the prism is reflected at a cylindrical reflector.

In order that the invention may be more readily understood reference is made to the accompanying drawing which illustrates diagrammatically and by way of example one embodiment thereof and where the FIGURE is a schematical view of the inventional arrangement.

A light source 1 emits a directed light beam which subsequently passes a condensor lens 2, a slit aperture 3 an optical imaging system 4 and a prism 5 along an optical axis O—O.

The light source 1 illuminates via the condensor lens 2 the slit aperture 3, which, in turn, is imaged by the imaging system 4 on to the prism 5.

The latter splits the light beam into a dispersed bundle of light 6 which impinges upon a cylindrical reflector 7, having an axis Z—Z, from whence it is reflected to yield a projection image of the shape of a rainbow 9 on a projector plane 8, defined by the straight lines 8' and 8''. The position of the prism 5 ensures that the sequence of colours of a rainbow as occuring in nature, namely inside violet, outside red, is kept to by the projected rainbow 9. The shape of the rainbow 9 is adjusted by the position and shape of the cylindrical reflector 7. The axis Z—Z of the latter and the common axis O—O of the components 1 to 5, in particular of the imaging system 4 include an angle $\alpha$.

The shape of the artificial rainbow 9, that is, its radius is varied by varying the angle $\alpha$ which, in turn, is effected by tilting the cylindrical reflector 7 about an axis B—B, which is substantially at right angles to the axis Z—Z of the cylindrical reflector 7. The direction of tilt is shown by a double arrow 10. When $\alpha=42°$, the reflected rainbow 9 has a radius of curvature of 42°, which corresponds to the condition in nature, provided that the cylindrical reflector 7 is positioned at the place of an observer.

When the projection arrangement is in a different position, compared to the former one, and when the radius of curvature is required to be 42°, a different angle $\alpha$ has to be adjusted.

Therefore it is of advantage when the projection arrangement is rotatable about an axis A—A and the axis B—B in order to obtain a natural representation of the position of a rainbow in dependence on the day time course of the sun. The axes A—A, O—O, and Z—Z define a plane which is at right angles to the projection plane 8 and to that plane which is defined by the axis B—B and Z—Z.

The desired length of the artificial rainbow 9 is obtained by a suitable adjustment of the slit width of the aperture. To comply with the natural conditions concerning the width of the rainbow 9, it is of advantage to select the width and the material of the prism 5 such that the colours visible to the unaided eye include an angle of 1.5°. A variation of the slit 3 width permits the effect of a partial blending of the colours as it occurs in nature.

We claim:

1. An arrangement for spectral dispersion of a bundle of light, particularly for producing artificial rainbows in planetaria, comprising a light source for producing a directed bundle of light, a condensor lens, an aperture, said light source and said condensor lens illuminating said aperture, an imaging system, a prism, said imaging system being for imaging said aperture upon said prism, said prism spectrally dispersing said bundle of light, and a cylindrical reflector having a cylinder axis and being tiltable about a first axis substantially at right angles to said cylinder axis, said light source, said condenser lens, said imaging system, said prism and said cylindrical reflector being arranged in optical alignment about a common optical axis and being tiltable about said first axis and about a second axis, said second axis being substantially at right angles to that plane being defined by said cylinder axis and said first axis.

* * * * *